US010393384B2

(12) United States Patent
Dalton, III et al.

(10) Patent No.: US 10,393,384 B2
(45) Date of Patent: Aug. 27, 2019

(54) WAVE ROTOR WITH CANCELING RESONATOR

(71) Applicant: Rolls-Royce North American Technologies, Inc., Indianapolis, IN (US)

(72) Inventors: William N. Dalton, III, Avon, IN (US); Philip H. Snyder, Avon, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 432 days.

(21) Appl. No.: 15/163,276

(22) Filed: May 24, 2016

(65) Prior Publication Data

US 2016/0363138 A1 Dec. 15, 2016

Related U.S. Application Data

(60) Provisional application No. 62/173,171, filed on Jun. 9, 2015.

(51) Int. Cl.

| | |
|---|---|
| ***F23R 3/56*** | (2006.01) |
| ***F23R 7/00*** | (2006.01) |
| *F04D 23/00* | (2006.01) |
| *F04D 29/28* | (2006.01) |
| *F04D 29/66* | (2006.01) |

(52) U.S. Cl.

CPC ..... *F23R 3/56* (2013.01); *F23R 7/00* (2013.01); *F04D 23/006* (2013.01); *F04D 29/284* (2013.01); *F04D 29/667* (2013.01); *F23R 2900/00014* (2013.01)

(58) Field of Classification Search

CPC .... F04D 29/667; F04D 23/006; F04D 29/284; F23R 7/00; F23R 3/56; F23R 2900/0014

USPC ..... 60/725

See application file for complete search history.

(56) References Cited

U.S. PATENT DOCUMENTS

| | | | | |
|---|---|---|---|---|
| 2,970,745 | A | 2/1961 | Berchtold | |
| 3,082,934 | A | 3/1963 | Dudley | |
| 5,267,432 | A | 12/1993 | Paxson | |
| 5,297,384 | A | 3/1994 | Paxson | |
| 5,894,719 | A | 4/1999 | Nalim et al. | |
| 6,370,879 | B1 * | 4/2002 | Stalder | F23D 14/46 431/114 |

(Continued)

FOREIGN PATENT DOCUMENTS

| | | | |
|---|---|---|---|
| EP | 0039459 | A1 | 10/1983 |
| EP | 1568869 | A1 | 8/2005 |

(Continued)

OTHER PUBLICATIONS

Extended European Search Report, European Application No. 16172993.4-1605, dated Nov. 14, 2016, 9 pages.

(Continued)

*Primary Examiner* — Ted Kim

(74) *Attorney, Agent, or Firm* — Barnes & Thornburg LLP

(57) ABSTRACT

A wave rotor includes an inlet end plate, a rotor drum, and an outlet end plate. The inlet end plate is arranged to direct a flow of gasses into rotor passages formed in the rotor drum. The rotor drum is arranged to receive the gasses. The outlet end plate is arranged to direct the gasses out of the rotor drum.

17 Claims, 6 Drawing Sheets

(56) References Cited

U.S. PATENT DOCUMENTS

| | | | | |
|---|---|---|---|---|
| 6,460,342 | B1 * | 10/2002 | Nalim | F02C 3/02 60/39.45 |
| 7,137,243 | B2 | 11/2006 | Snyder et al. | |
| 7,555,891 | B2 | 7/2009 | Muller et al. | |
| 7,621,118 | B2 | 11/2009 | Snyder et al. | |
| 8,443,583 | B2 | 5/2013 | Nalim et al. | |
| 2005/0223707 | A1 * | 10/2005 | Ikeda | F23R 3/04 60/725 |
| 2007/0157625 | A1 | 7/2007 | Snyder et al. | |
| 2010/0192536 | A1 * | 8/2010 | Rasheed | F02C 5/02 60/39.38 |
| 2012/0204534 | A1 | 8/2012 | Kenyon et al. | |
| 2012/0216503 | A1 * | 8/2012 | Snyder | F02C 3/02 60/39.38 |
| 2013/0327010 | A1 | 12/2013 | Muller et al. | |

FOREIGN PATENT DOCUMENTS

| | | | |
|---|---|---|---|
| WO | WO 81/03201 | * | 4/1980 |
| WO | 02/04794 | A2 | 1/2002 |
| WO | 2005124159 | A1 | 12/2005 |

OTHER PUBLICATIONS

Snyder, Philip H., "Seal Technology Development for Advanced Component for Airbreathing Engines," NASA/CR-2008-215479, Dec. 2008.

European Office Action, dated Jan. 16, 2019 in connection with European Application No. 16172993A, 6 pages.

* cited by examiner

WAVE ROTOR WITH CANCELING RESONATOR

CROSS REFERENCE TO RELATED APPLICATIONS

This application claims priority to and the benefit of U.S. Provisional Patent Application No. 62/173,171, filed 9 Jun. 2015, the disclosure of which is now expressly incorporated herein by reference.

FIELD OF THE DISCLOSURE

The present disclosure relates generally to fluid flow devices, and more specifically to wave rotors.

BACKGROUND

Some wave rotors compress gasses with generally unsteady shock or compression waves and allow the gasses to expand by expansion waves. Typical wave rotors include an inlet end plate, an outlet end plate spaced apart from the inlet end plate along a central axis of the wave rotor, and a rotor drum positioned therebetween. The inlet port (or aperture) in the inlet end plate directs a flow of gasses into rotor passages formed in the rotor drum. The rotor drum defines passages that compress the gasses as the rotor drum rotates about the central axis relative to the inlet end plate and the outlet end plate. The outlet port in the exit end plate directs the gasses out of the rotor drum. The compression waves within the rotor passages may cause pressure pulses to travel upstream within the inlet port. The exit gasses may exit the outlet end plate port with high pressure pulses traveling within the exit flow.

SUMMARY

The present disclosure may comprise one or more of the following features and combinations thereof.

According to a first aspect of the present disclosure, a wave rotor may include a rotor drum and a first end plate. The rotor drum may be mounted for rotation about a central axis of the wave rotor. The rotor drum may be formed to include a plurality of rotor passages that extend along the central axis. The first end plate may be aligned axially with the rotor drum and formed to include a port aperture extending axially through the first end plate along an arc around the central axis and aligned radially with the rotor passages.

In illustrative embodiments, the wave rotor may include a first cancelling resonator. The first canceling resonator may include a body and a neck that cooperate to define a cavity. The neck may be narrower than the body and is formed to include a mouth positioned adjacent to the port aperture.

In illustrative embodiments, the first end plate may include a leading edge wall and a trailing edge wall spaced apart circumferentially from the leading edge wall to form portions of the port aperture. The rotor passages may be configured to rotate in a direction from the leading edge wall to the trailing edge wall. The mouth may be positioned adjacent to the leading edge wall. The first canceling resonator may extend circumferentially away from the port aperture.

In illustrative embodiments, the wave rotor may include a second canceling resonator. A mouth of the second canceling resonator may be positioned adjacent to the trailing edge wall. The second canceling resonator may extend circumferentially away from the port aperture and the first canceling resonator.

In illustrative embodiments, the first end plate may include a leading edge wall, a trailing edge wall spaced apart circumferentially from the leading edge wall, a radial outer wall interconnecting the leading edge wall and the trailing edge wall, and a radial inner wall radially spaced apart from the radial outer wall and interconnecting the leading edge wall and the trailing edge wall to form the port aperture. The mouth may be positioned adjacent to one of the radial outer wall and the radial inner wall. The first canceling resonator may extend radially away from the port aperture.

In illustrative embodiments, the wave rotor may include a second end plate axially spaced apart from the first end plate and a second canceling resonator. The first end plate may positioned at an outlet end of the rotor drum. The second end plate may be positioned at an inlet end of the rotor drum. A mouth of the second canceling resonator may be positioned adjacent to a second port aperture formed in the second end plate.

In illustrative embodiments, the first canceling resonator may have a tuned frequency that is about equal to a frequency of pressure pulsations produced as the rotor passages pass the port aperture when the rotor drum is rotated.

In illustrative embodiments, the first canceling resonator may further include a frequency adjuster configured to vary a volume of the body to vary a tuned frequency of the first canceling resonator. The tuned frequency may be about equal to a frequency of the rotor passages passing the port aperture when the rotor drum is rotated.

In illustrative embodiments, the first canceling resonator may include an orifice plate covering the mouth of the first canceling resonator and may be formed to include a plurality of orifices extending through the orifice plate.

According to another aspect of the present disclosure, a wave rotor may include a rotor drum and an outlet plate. The rotor drum may be mounted for rotation about a central axis of the wave rotor. The rotor drum may be formed to include a plurality of rotor passages that extend along the central axis. The outlet end plate may be aligned axially with the rotor drum and may be formed to include an outlet port aperture extending axially through the outlet end plate along an arc around the central axis and aligned radially with the rotor passages. The outlet end plate may include a leading edge wall and a trailing edge wall spaced apart circumferentially from the leading edge wall to define a portion of the outlet port aperture. The rotor passages may be configured to rotate in a direction from the leading edge wall to the trailing edge wall.

In illustrative embodiments, the wave rotor may include a first canceling resonator including a body and a neck that cooperate to define a cavity. The neck may be narrower than the body and may be formed to include a mouth positioned adjacent to the leading edge wall.

In illustrative embodiments, the first canceling resonator may extend circumferentially away from the outlet port aperture. The wave rotor may include a second canceling resonator and a mouth of the second canceling resonator may be positioned adjacent to the trailing edge wall. The second canceling resonator may extend circumferentially away from the outlet port aperture and the first canceling resonator.

In illustrative embodiments, the outlet end plate may further include a radial outer wall interconnecting the leading edge wall and the trailing edge wall and a radial inner wall radially spaced apart from the radial outer wall and interconnecting the leading edge wall and the trailing edge wall to form the port aperture. The mouth may be positioned adjacent to one of the radial outer wall and the radial inner wall. The first canceling resonator may extend radially away from the outlet port aperture.

In illustrative embodiments, the wave rotor may include a second canceling resonator and an inlet end plate axially spaced apart from the outlet end plate. A mouth of the second canceling resonator may be positioned adjacent to an inlet port aperture formed in the inlet end plate.

In illustrative embodiments, the first canceling resonator may have a tuned frequency about equal to a frequency of pressure pulses produced as the rotor passages pass the port aperture when the rotor drum is rotated. The tuned frequency may be about equal to a frequency of the rotor passages passing the port aperture when the rotor drum is rotated.

In illustrative embodiments, the first canceling resonator further includes a frequency adjuster configured to vary a volume of the body to vary the tuned frequency of the first canceling resonator.

In illustrative embodiments, the first canceling resonator may include an orifice plate covering the mouth of the first canceling resonator and formed to include a plurality of orifices extending through the orifice plate.

According to another aspect of the present disclosure, a method of canceling pressure pulses produced by a wave rotor is taught. The method may include operating a wave rotor to produce high pressure pulses of gasses at a port aperture of the wave rotor, forcing a portion of the high pressure pulses of gasses into a cavity to increase a pressure inside the cavity, and releasing the gasses inside the cavity during intervals between the high pressure pulses of gasses to decrease the pressure inside the cavity.

In illustrative embodiments, the method may include tuning the cavity to a frequency of the high pressure pulses These and other features of the present disclosure will become more apparent from the following description of the illustrative embodiments.

DETAILED DESCRIPTION

Figure 1:
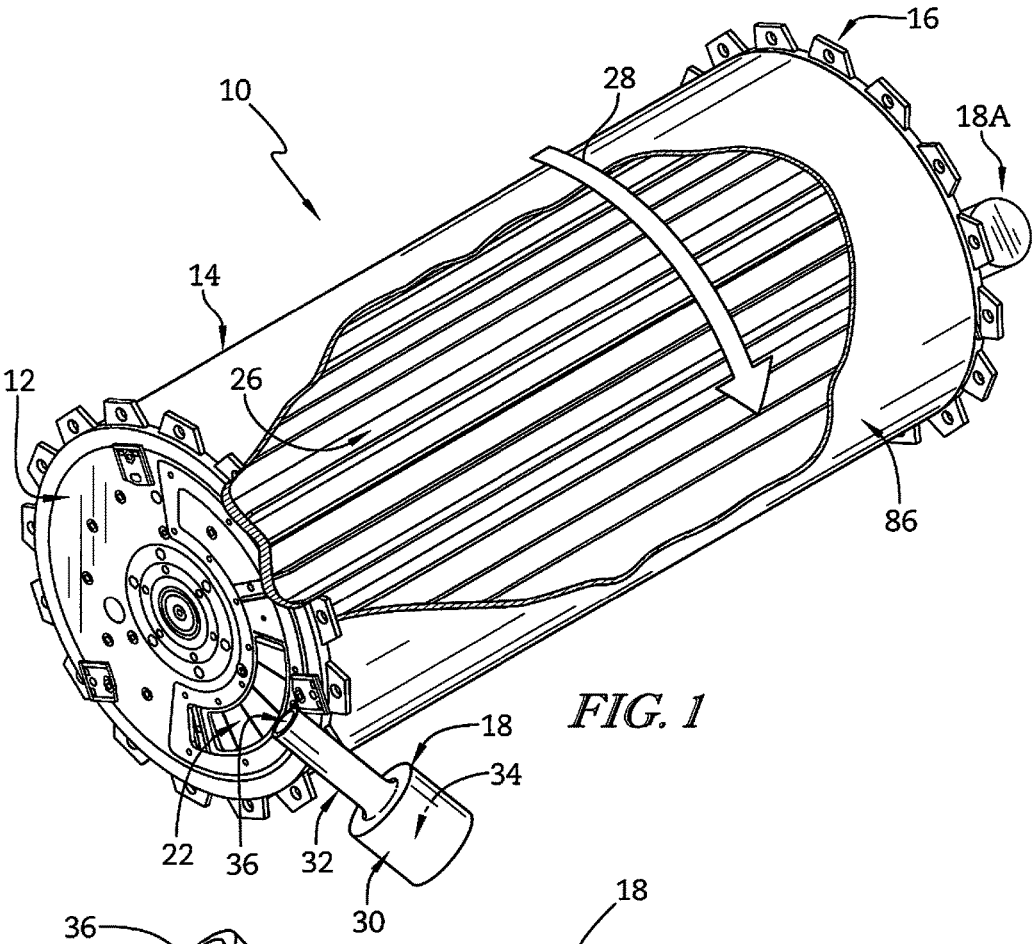
FIG. 1 is a cutaway view of a wave rotor including from left to right, an inlet end plate having an inlet port aperture, a canceling resonator, a rotor drum formed to include a plurality of rotor passages that rotate about a central axis, and an outlet end plate and showing that a mouth of the canceling resonator is positioned adjacent to the inlet port aperture to cancel pressure pulses produced as the rotor passages pass the inlet port aperture when the rotor drum is rotated.

For the purposes of promoting an understanding of the principles of the disclosure, reference will now be made to a number of illustrative embodiments illustrated in the drawings and specific language will be used to describe the same.

An illustrative wave rotor 10 in accordance with the present disclosure is shown in FIG. 1. The wave rotor 10 is configured to receive and compress a flow of fluids and expel the fluids for application in a plurality of industrial uses. Typical wave rotors expel fluids which contain some amount of high pressure pulses. The wave rotor 10 includes a canceling resonator configured to cancel the pressure pulses produced during operation of the wave rotor 10 to provide a steady flow of expelled outlet fluids. The disclosed features may be included in wave rotors used as pressure exchangers, combustors, flow dividers, flow combiners, etc The illustrative wave rotor 10 is configured to receive fluids such as, for example, gasses including combustible gas mixtures and use transient internal fluid flow including, but not limited to, combustion to compress the fluids. In the illustrative embodiment, the wave rotor 10 includes an inlet end plate 12, a rotor drum 14, an outlet end plate 16, and a canceling resonator 18 as shown in FIG. 1. The inlet end plate 12 is formed to include an inlet port aperture 22 that extends circumferentially along an arc about a central axis 20 of the wave rotor 10. The outlet end plate 16 is formed to include an outlet port aperture 24 that extends circumferentially along an arc about the central axis 20 of the wave rotor 10. The rotor drum 14 is mounted for rotation relative to the inlet end plate 12 and the outlet end plate 16 about the central axis 20. The canceling resonator 18 is configured to cancel pressure pulsations produced by the wave rotor 10 when the rotor drum 14 is rotated.

The rotor drum 14 is formed to include a plurality of rotor passages 26 that extend along the central axis 20 as shown in FIG. 1. In the illustrative embodiment, the rotor passages 26 rotate about the central axis 20 in a clockwise direction as indicated by arrow 28. The rotor passages 26 are arranged so that the rotor passages 26 align with the inlet port aperture 22 at predetermined intervals when the rotor drum 14 rotates about the central axis 20 to allow the fluids to flow through the inlet port aperture 22 into the rotor passages 26. The rotor passages 26 are temporarily sealed at their ends and the fluids inside are compressed. The rotor passages 26 align with the outlet port aperture 24 at predetermined intervals when the rotor drum 14 rotates about the central axis 20 to allow the compressed fluids in the rotor passages 26 to flow through the outlet port aperture 24 out of the wave rotor 10.

The wave rotor 10 produces unsteady flow such as the pulses of high pressure gasses, for example, at the outlet port aperture 24 as each rotor passage 26 aligns with the outlet port aperture 24. Similarly, pressure pulses may be produced at the inlet port aperture 22 as each rotor passage 26 aligns with the inlet port aperture 22. A number of factors may contribute to the production of pressure pulses, including the finite number of rotor passages 26, the gradual opening process of the rotor passages 26 into the port apertures 22, 24, and the arrival of pressure waves within each rotor passage 26 due to design constraints on the internal temporal cycle in the wave rotor 10. The unsteadiness may degrade the performance and life of components upstream and downstream of the wave rotor 10. The canceling resonators 18 are located adjacent to the port apertures 22, 24 and are configured to cancel pressure pulsations produced as the rotor passages 26 pass the port apertures 22, 24 when the rotor drum 14 is rotated.

Figure 4:
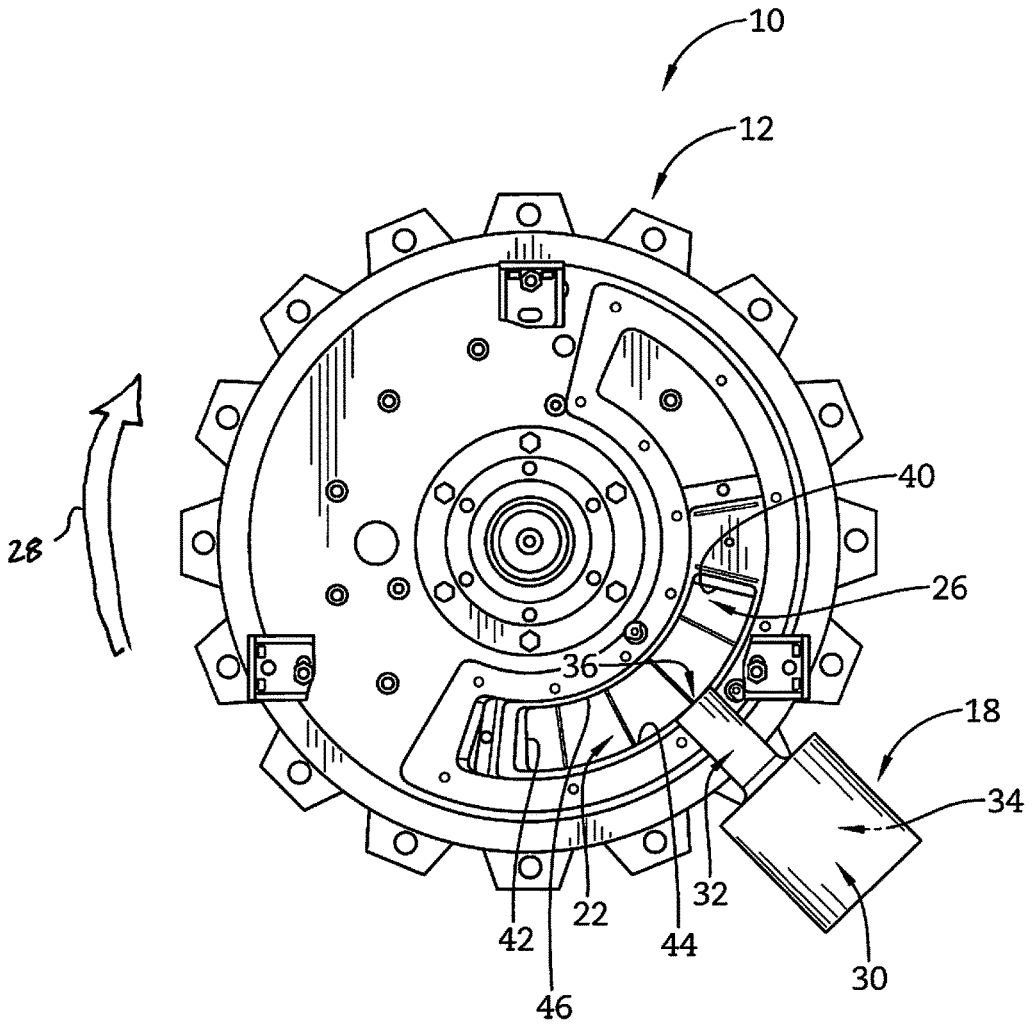
FIG. 4 is an elevation view of the inlet end plate and a canceling resonator, the inlet end plate is formed to include a leading edge wall, a trailing edge wall spaced apart circumferentially from the leading edge wall, a radial outer wall interconnecting the leading edge wall and the trailing edge wall, and a radial inner wall radially spaced apart from the radial outer wall and interconnecting the leading edge wall and the trailing edge wall to form the inlet port aperture, the mouth of the canceling resonator is positioned adjacent to the radial outer wall, and the canceling resonator extends radially away from the inlet port aperture.

The inlet end plate 12 includes a leading edge wall 40, a trailing edge wall 42, a radial outer wall 44, and a radial inner wall 46 that cooperate to form the inlet port aperture 22 as shown in FIG. 4. The leading edge wall 40 extends radially. The trailing edge wall 42 is spaced apart circumferentially from the leading edge wall 40. The radial outer wall 44 extends circumferentially and interconnects the leading edge wall 40 and the trailing edge wall 42. The radial inner wall 46 extends circumferentially. The radial inner wall 46 is radially spaced apart from the radial outer wall 44 and interconnects the leading edge wall 40 and the trailing edge wall 42 to form the inlet port aperture 22.

Figure 5:
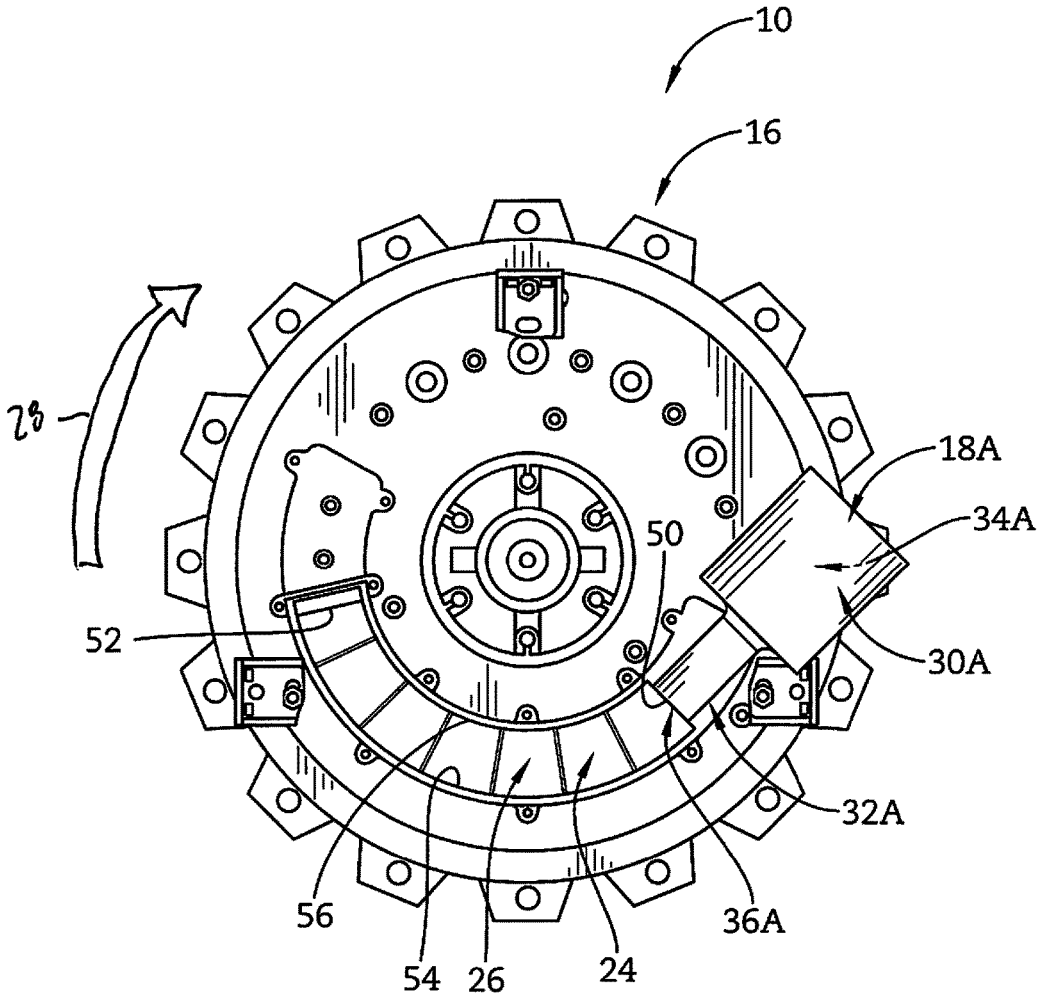
FIG. 5 is an elevation view of the outlet end plate and a canceling resonator, the outlet end plate is formed to include a leading edge wall, a trailing edge wall spaced apart circumferentially from the leading edge wall, a radial outer wall interconnecting the leading edge wall and the trailing edge wall, and a radial inner wall radially spaced apart from the radial outer wall and interconnecting the leading edge wall and the trailing edge wall to form the outlet port aperture, the mouth of the canceling resonator is positioned adjacent to the leading edge wall, and the canceling resonator extends circumferentially away from the outlet port aperture.

The outlet end plate 16 includes a leading edge wall 50, a trailing edge wall 52, a radial outer wall 54, and a radial inner wall 56 that cooperate to form the outlet port aperture 24 as shown in FIG. 5. The leading edge wall 50 extends radially. The trailing edge wall 52 is spaced apart circumferentially from the leading edge wall 50. The radial outer wall 54 extends circumferentially and interconnects the leading edge wall 50 and the trailing edge wall 52. The radial inner wall 56 extends circumferentially. The radial inner wall 56 is radially spaced apart from the radial outer wall 54 and interconnects the leading edge wall 50 and the trailing edge wall 52 to form the outlet port aperture 24.

Figure 8:
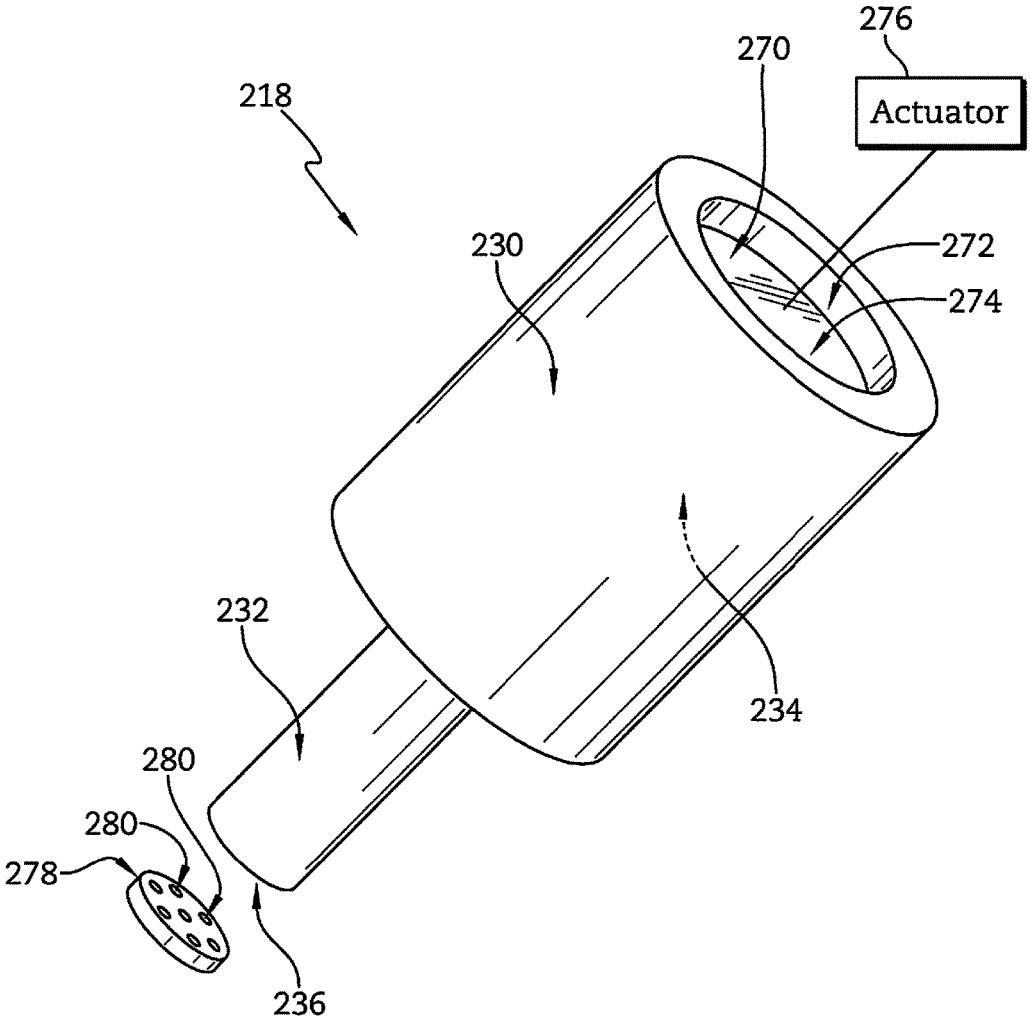
FIG. 8 is another embodiment of a canceling resonator including a frequency adjuster configured to vary a volume of the body to vary a tuned frequency of the first canceling resonator and an orifice plate configured to cover the mouth of the first canceling resonator and formed to include a plurality of orifices extending through the orifice plate.

In the illustrative embodiment, the rotor passages 26 rotate about the central axis 20 in a direction from the leading edge wall 40, 50 toward the trailing edge wall 42, 52. In some embodiments, the inlet end plate 12 includes a single inlet port aperture 22 and the outlet end plate 16 includes a single outlet port aperture 24 as shown in FIGS. 4 and 5. In other embodiments, the inlet end plate 12 is formed to include a plurality of inlet port apertures 22 and the outlet end plate 16 is formed to include a plurality of outlet port apertures 24 as shown in FIG. 8. In some embodiments, both inlet and exit ports may be located on the same endplate.

Figure 2:
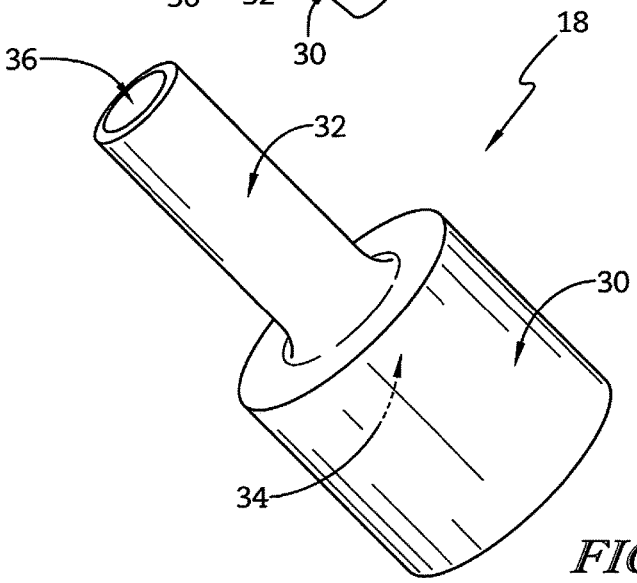
FIG. 2 is a perspective view of the canceling resonator of FIG. 1 showing that the canceling resonator includes a body and a neck that cooperate to define a cavity, the neck is narrower than the body and formed to include a mouth configured to be positioned adjacent to the inlet port aperture to cancel the pressure pulses.
Figure 3:
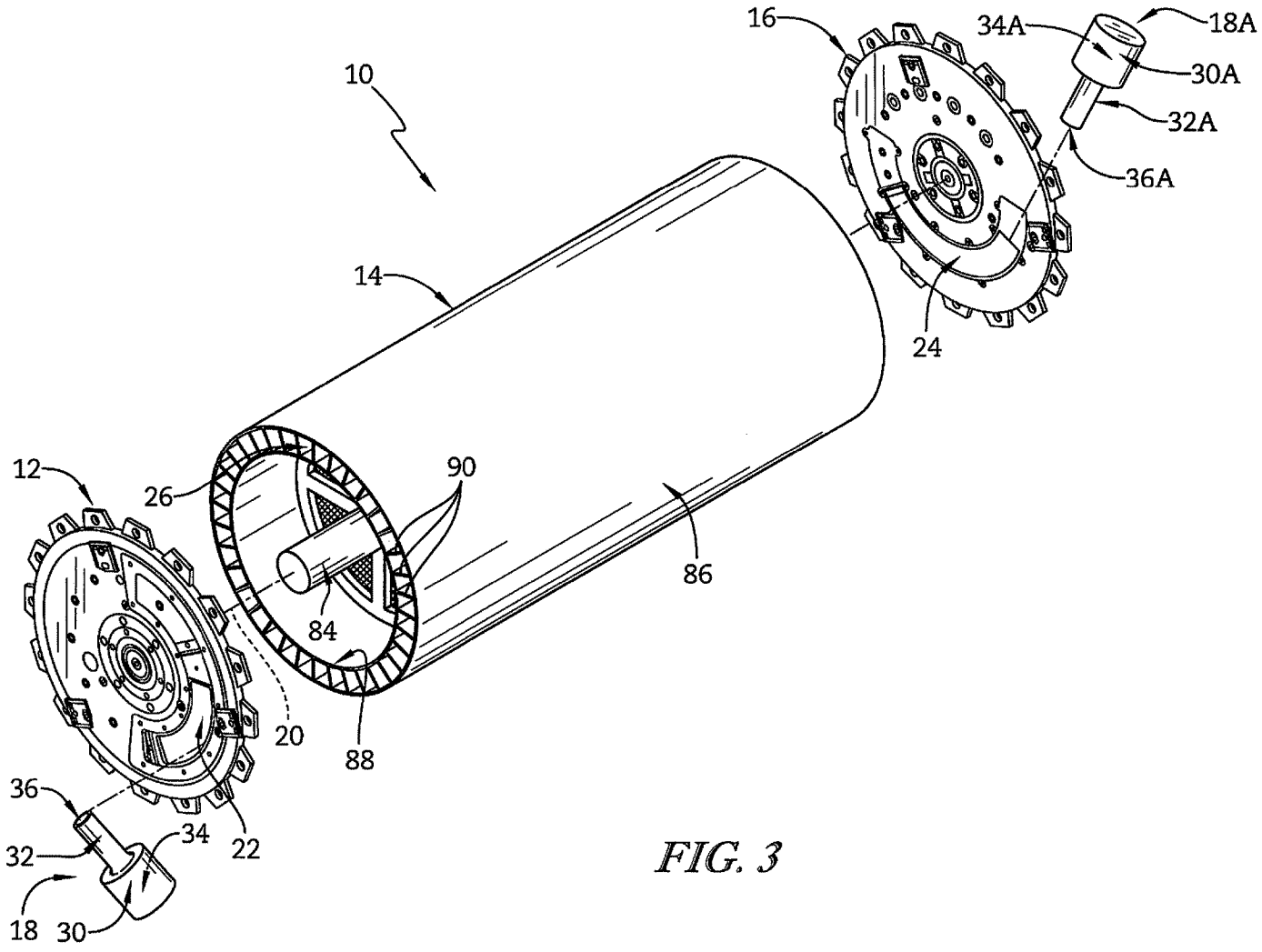
FIG. 3 is an exploded view of the wave rotor showing that the wave rotor includes, from left to right, the inlet end plate, an inlet canceling resonator configured to be positioned adjacent to the inlet port aperture, the rotor drum arranged to rotate relative to the inlet end plate and the outlet end plate to cause the rotor passages to receive, compress, and expel gasses, the outlet end plate formed to include an outlet port aperture arranged to direct exit flow containing pulses of high pressure gasses out of the rotor passages, and an outlet canceling resonator configured to be positioned adjacent to the outlet port aperture.

The canceling resonator 18 includes a body 30 and a neck 32 as shown in FIG. 2. The body 30 and the neck 32 cooperate to define a cavity 34. The neck 32 is formed to include a mouth 36 that opens into the cavity 34. The mouth 36 is positioned adjacent to one of the port apertures 22, 24 as shown in FIG. 1. In the illustrative embodiments, the neck 32 is narrower than the body 30.

The mouth 36 is positioned adjacent to a port 22, 24 so that a portion of the high pressure pulses of gasses expelled from the wave rotor 10 are forced into the cavity 34 to increase a pressure inside the cavity 34. Between intervals of high pressure pulses, the gasses inside the cavity 34 are released and the pressure inside the cavity 34 is decreased. The decreased pressure in the cavity 34 draws gasses back into the cavity 34 and the magnitude of the pressure changes decreases for each iteration.

The canceling resonator 18 has a tuned frequency. The canceling resonator 18 is more effective for frequencies that are within a range of the tuned frequency. In some embodiments, the tuned frequency is about equal to a frequency of the pressure pulsations produced as the rotor passages 26 pass the port aperture 22, 24 when the rotor drum 14 is rotated. In the illustrative embodiment, the tuned frequency is about equal to a frequency of the rotor passages 26 passing the port aperture 22, 24 when the rotor drum 14 is rotated. In some embodiments, the canceling resonator 18 further includes a frequency adjuster 270 configured to vary a volume of the body 30 to vary the tuned frequency of the canceling resonator as shown in FIG. 8.

The mouth 36 of the canceling resonators 18 may be positioned in one of a plurality of locations adjacent to the port apertures 22, 24. The canceling resonators 18 may be positioned adjacent to the port apertures 22, 24 along any of the leading edge wall 40, 50, trailing edge wall 42, 52, radial outer wall 44, 54, and radial inner wall 46, 56. The canceling resonators 18 may be oriented to extend in one of a plurality of orientations. As an example, each canceling resonator 18 may extend radially, axially, circumferentially, or any combination thereof relative to the port apertures 22, 24.

The illustrative wave rotor 10 shown in FIGS. 1-5 includes an inlet canceling resonator 18 positioned adjacent to the inlet port aperture 22 and an outlet canceling resonator 18A positioned adjacent to the outlet port aperture 24. The inlet and outlet canceling resonators 18, 18A may be different or identical to one another in size, position, orientation, tuned frequency, etc.

The mouth 36 of the inlet canceling resonator 18 is positioned adjacent to the radial outer wall 44 of the inlet port aperture 22 as shown in FIG. 4. The mouth 36 is positioned about midway between the leading edge wall 40 and the trailing edge wall 42. The inlet canceling resonator 18 extends radially outward away from the port aperture.

The mouth 36A of the outlet canceling resonator 18A is positioned adjacent to the leading edge wall 50 of the outlet port aperture 24 as shown in FIG. 5. The outlet canceling resonator 18A extends circumferentially away from the outlet port aperture 24. The expelled high pressure pulses may have the largest pressure near the leading edge wall 50.

Figure 6:
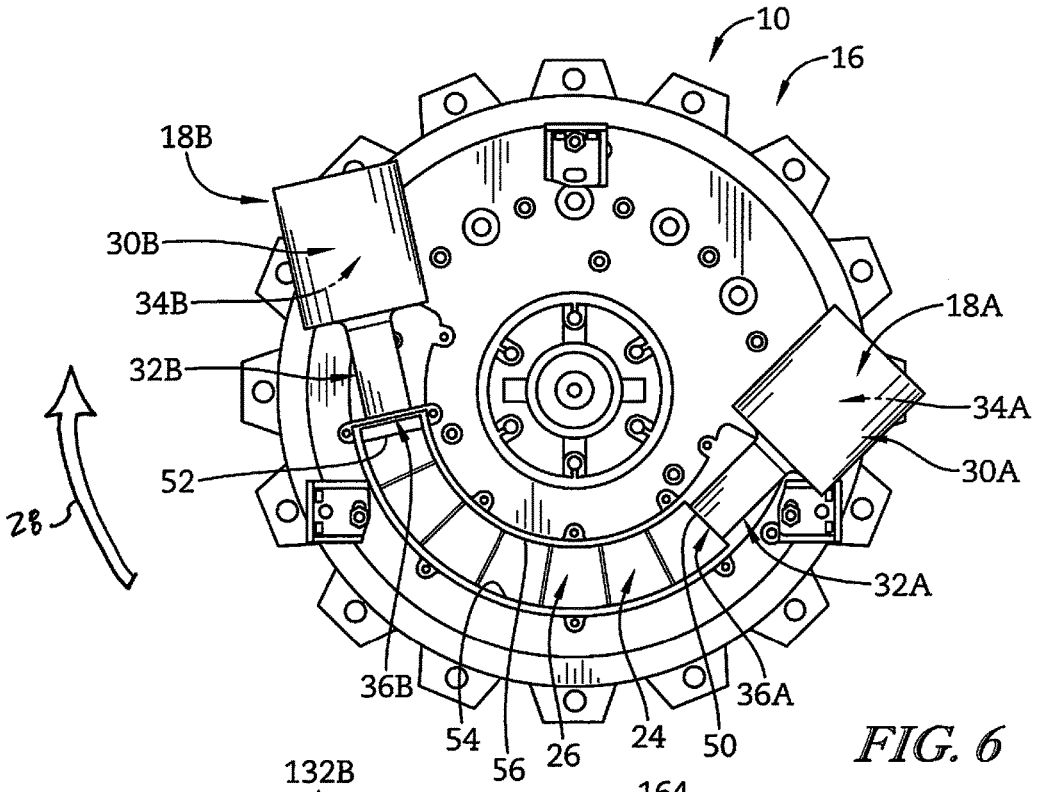
FIG. 6 is an elevation view of an outlet end plate of a wave rotor having two canceling resonators positioned at the outlet port aperture, a mouth of a first outlet canceling resonator is positioned adjacent to the leading edge wall of the outlet port aperture, a mouth of a second outlet canceling resonator is positioned adjacent to the trailing edge wall of the outlet port aperture, the first outlet canceling resonator extends circumferentially away from the outlet port aperture in a first direction, and the second outlet canceling resonator extends circumferentially away from the outlet port aperture in a second direction.

In another illustrative embodiment, the wave rotor 10 includes the first outlet canceling resonator 18A and a second outlet canceling resonator 18B as shown in FIG. 6. The second outlet canceling resonator 18B includes a body 30B and a neck 32B coupled to the body 30B. The second outlet canceling resonator 18B is substantially similar to the first outlet canceling resonator 18A.

The mouth 36B of the second outlet canceling resonator 18B is positioned adjacent to the trailing edge wall 52 of the outlet port aperture 24 as shown in FIG. 6. The second outlet canceling resonator 18B extends circumferentially away from the outlet port aperture 24 and the first outlet canceling resonator 18A.

A method of canceling pressure pulses produced by the wave rotor 10 may include a number of steps. The method may include operating the wave rotor 10 to produce high pressure pulses of gasses at a port aperture 22, 24 of the wave rotor 10, forcing a portion of the high pressure pulses of gasses into the cavity 34 to increase a pressure inside the cavity 34, and releasing the gasses inside the cavity 34 during intervals between the high pressure pulses of gasses to decrease the pressure inside the cavity 34. The method may further include tuning the cavity 34 to a frequency of the high pressure pulses.

Figure 7:
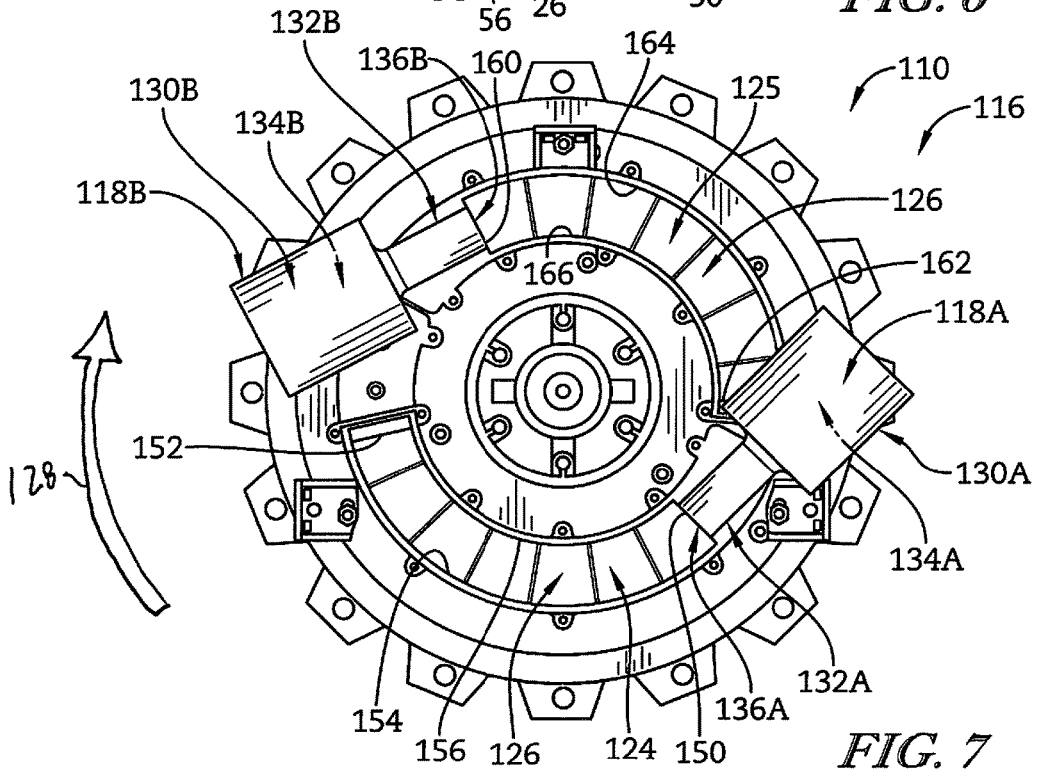
FIG. 7 is an elevation view of an outlet end plate of another embodiment of a wave rotor, the outlet end plate includes a first outlet port aperture and a second outlet port aperture, a mouth of a first outlet canceling resonator is positioned adjacent to the leading edge wall of the first outlet port aperture, a mouth of a second outlet canceling resonator is positioned adjacent to the leading edge wall of the second outlet port aperture, the first outlet canceling resonator extends circumferentially away from the first outlet port aperture in a first direction, and the second outlet canceling resonator extends circumferentially away from the second outlet port aperture in a second direction.

Another illustrative wave rotor 110 is shown in FIG. 7. The wave rotor 110 is substantially similar to the wave rotor 10 shown in FIGS. 1-5 and described herein. Accordingly, similar reference numbers in the 100 series indicate features that are common between the wave rotor 10 and the wave rotor 110. The description of the wave rotor 10 is hereby incorporated by reference to apply to the wave rotor 110, except in instances when it conflicts with the specific description and drawings of the wave rotor 110.

The wave rotor 110 includes an inlet end plate, a rotor drum, and an outlet end plate 116 as shown in FIG. 7. The inlet end plate is formed to include a first and a second inlet port aperture and the outlet end plate 116 is formed to include a first and a second outlet port aperture 124, 125. The outlet end plate 116 includes a leading edge wall 150, a trailing edge wall 152, a radial outer wall 154, and a radial inner wall 156 that cooperate to form the outlet port aperture 124 as shown in FIG. 7. The outlet end plate 116 further includes a leading edge wall 160, a trailing edge wall 162, a radial outer wall 164, and a radial inner wall 166 that cooperate to form the outlet port aperture 125.

The wave rotor 110 includes a first outlet canceling resonator 118A and a second outlet canceling resonator 118B. A mouth 136A of the first outlet canceling resonator 118A is positioned adjacent to the leading edge wall 150 of the first outlet port aperture 124 as shown in FIG. 7. The first outlet canceling resonator 118A extends circumferentially away from the first outlet port aperture 124. A mouth 136B of the second outlet canceling resonator 118B is positioned adjacent to the leading edge wall 160 of the second outlet port aperture 125. The second outlet canceling resonator 118B extends circumferentially away from the second outlet port aperture 125.

Another illustrative canceling resonator 218 is shown in FIG. 8. The canceling resonator 218 is substantially similar to the canceling resonator 18 shown in FIGS. 1-5 and described herein. Accordingly, similar reference numbers in the 200 series indicate features that are common between the canceling resonator 218 and the canceling resonator 18. The description of the canceling resonator 18 is hereby incorporated by reference to apply to the canceling resonator 218, except in instances when it conflicts with the specific description and drawings of the canceling resonator 218.

The canceling resonator 218 includes a body 230 and a neck 232 as shown in FIG. 8. The body 230 and neck 232 cooperate to define a cavity 234. The neck 232 is formed to include a mouth 236 that opens into the cavity 234. In the illustrative embodiments, the neck 232 is narrower than the body 30.

The canceling resonator 218 includes a frequency adjuster 270 configured to vary a tuned frequency of the canceling resonator 218 as shown in FIG. 8. In the illustrative embodiment, the frequency adjuster 270 is configured to vary a volume of the body 230 to vary the tuned frequency of the canceling resonator 218. In some embodiments, the canceling resonator 218 has a tuned frequency about equal to the frequency of pressure pulses produced as the rotor passages 26 pass the port apertures 22, 24, 124, 125 when the rotor drum 14 is rotated. The frequency adjuster 270 allows the tuned frequency of the canceling resonator 218 to change if the rotor passage frequency changes such as, for example, to increase or decrease the flow rate of the wave rotor 10, 110.

As shown in FIG. 8, the body 230 is formed to include an aperture 272 that opens into the cavity 234. The frequency adjuster 270 includes a movable plate 274 positioned in the aperture 272. The plate 274 is configured to move in the cavity 234 to vary a volume of the cavity 234. In the illustrative embodiment, an actuator 276 is coupled to the plate 274 and configured to move the plate 274 relative to the body 230.

The canceling resonator 218 includes an orifice plate 278 as shown in FIG. 8. The orifice plate 278 is arranged to cover the mouth 236 of the canceling resonator 218. The orifice plate 278 is formed to include a plurality of orifices 280 extending through the orifice plate 278.

Referring to FIGS. 1-5, in one example of the wave rotor 10, the inlet and outlet end plates 12, 16 are spaced apart from the rotor drum 14 to form a gap between the rotor drum 14 and each end plate 12, 16 to control the passage of flow into and out of the rotor passages 26. In some embodiments, the end plates 12, 16 are arranged to seal the rotor drum 14 to minimize leakage of flow out of the rotor passage 26. The rotor drum 14 is mounted for rotation about the central axis 20 relative to the inlet end plate 12 and outlet end plate 16. In other embodiments, the rotor drum 14 rotates in an opposite direction.

The rotor drum 14 includes an outer tube 86, an inner tube 88, and a plurality of webs 90 as shown in FIG. 1. The outer tube 86, the inner tube 88, and the plurality of webs 90 cooperate to form the plurality of axially extending rotor passages 26. In the illustrative embodiment, the rotor passages 26 extend axially and generally parallel with the central axis 20. In other embodiments, the rotor passages 26 extend axially along and circumferentially about the central axis 20.

The outer tube 86 extends around the central axis 20 to form a radially outer portion of the rotor passages 26. The inner tube 88 extends around the central axis 20 and is positioned radially between the central axis 20 and the outer tube 86 to form a radially inner portion of the rotor passages 26. The plurality of webs 90 are spaced apart circumferentially and extend between and interconnect the outer tube 86 and the inner tube 88 to separate the plurality of rotor passages 26.

In the illustrative embodiment, the rotor passages 26 are generally parallel with the central axis 20 and the rotor drum 14 is rotated by a drive shaft 84. In other embodiments, the rotor passages 26 extend axially along and circumferentially around the central axis 20. In some embodiments, the rotor passages 26 are arranged to cause the rotor drum 14 to rotate as a result of the shape of the rotor passages 26 and/or a combustion process that may occur within the rotor passages 26.

As one example, the wave rotor 10 may be included in a gas turbine engine to power a turbine included in the gas turbine engine. The engine includes a compressor, the wave rotor 10, and the turbine. The compressor is configured to compress and deliver air to the wave rotor 10. The turbine extracts work from the combusted gasses (sometimes called hot high-pressure products or exhaust gasses) to drive the compressor and a fan assembly. The fan assembly pushes air through and around the engine to provide thrust for an aircraft. The wave rotor 10 is configured to use transient internal fluid flow to compress fuel and air prior to combustion and to confine the volume of the gas as combustion takes place for the purpose of improving the available amount of work that can be produced by the exit flow of the combustor.

During operation of the wave rotor 10, fuel and compressed air, produced by the compressor, is drawn axially into each rotor passage 26 through the inlet port aperture 22 formed in the inlet end plate 12. As each rotor passage 26 rotates about the central axis 20, the compressed air and fuel are mixed together and are then ignited to produce hot high-pressure products. The hot high-pressure products are blocked from escaping the rotor passage 26 by the inlet end plate 12 and an outlet end plate 16 until the rotor passage 26 aligns with the outlet port aperture 24 formed in the outlet end plate 16. The hot high-pressure products exit the rotor passage 26 through the outlet port aperture 24 into the turbine.

Pressure pulses may be observed in the inlet and exit flow of wave rotors 10 including, for example, combustors, pressure exchangers, flow dividers, flow combiners, etc. A cancelling resonator (sometimes called a Helmholtz resonator) may be used to achieve a degree of cancellation of pressure pulsations of a defined frequency. As one example, a canceling resonator 18 may be positioned adjacent to the location where a pressure pulse is propagating out of the rotor passages 26 of the wave rotor 10 and into the port of the wave rotor 10. The canceling resonator 18 may include an opening and a cavity adjacent to the opening in the form of a branch.

The tuned frequency of the canceling resonator 18 may be designed into the device and selected such that the frequency of the arriving series of pressure pulses matches that of the canceling resonator 18. In some embodiments, the tuned frequency is about equal to the passage passing frequency of the wave rotor 10.

The canceling pulses generated within the resonator 18 propagate into a duct connecting the wave rotor 10 and adjacent flow components. In some embodiments, the canceling resonator 18 opening is located on the outer wall of the port duct at the rotor end plate. In some embodiments, the canceling resonator opening is located on the inner wall of the port duct at the rotor end plate. In some embodiments, the canceling resonator opening is located on the leading edge of the port duct at the rotor end plate. In some embodiments, the canceling resonator opening is located on the trailing edge of the port duct at the rotor end plate. The location is selected based on the area of the canceling resonator 18 being adjacent to the area within the port where the pressure pulsation emanates from the rotor passages 26.

In some embodiments, the wave rotor ports form partial annulus ducts and the canceling resonator 18 is located in a region between the partial annulus ducts. In other embodiments, the canceling resonator 18 is located radially inward relative to the port. In other embodiments, the canceling resonator is located outward relative to the port. Some wave rotors 10 do not have axial passage orientation and, in such embodiments, the canceling resonator 18 may be located in alternative available positions.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A wave rotor comprising a rotor drum mounted for rotation about a central axis of the wave rotor, the rotor drum formed to include a plurality of combustion rotor passages that extend along the central axis, a first end plate aligned axially with the rotor drum and formed to include a port aperture extending axially through the first end plate along an arc around the central axis and aligned radially with the combustion rotor passages, and a first canceling resonator including a body and a neck that cooperate to define a cavity, wherein the neck is narrower than the body and is formed to include a mouth positioned directly adjacent to the port aperture, and wherein the first end plate includes a leading edge wall and a trailing edge wall spaced apart circumferentially from the leading edge wall to form portions of the port aperture which is formed in an interior portion of the first end plate, the combustion rotor passages are configured to rotate in a direction from the leading edge wall to the trailing edge wall, and the neck and body of the first canceling resonator are substantially aligned circumferentially along the arc of the port aperture such that the first canceling resonator extends circumferentially away from the port aperture.

2. The wave rotor of claim 1, wherein the mouth is positioned adjacent to the leading edge wall.

3. The wave rotor of claim 2, further including a second canceling resonator, a mouth of the second canceling resonator is positioned adjacent to the trailing edge wall, and the second canceling resonator extends circumferentially away from the port aperture and the first canceling resonator.

4. The wave rotor of claim 2, further including a second end plate axially spaced apart from the first end plate and a second canceling resonator, the first end plate is positioned at an outlet end of the rotor drum, the second end plate is positioned at an inlet end of the rotor drum, and a mouth of the second canceling resonator is positioned adjacent to a second port aperture formed in the second end plate.

5. The waver rotor of claim 2, wherein the mouth is positioned directly adjacent to the leading edge and the body and the neck are formed such that the only entrance into the cavity is through the mouth.

6. The wave rotor of claim 1, wherein the first canceling resonator has a tuned frequency that is about equal to a frequency of pressure pulsations produced as the combustion rotor passages pass the port aperture when the rotor drum is rotated.

7. The wave rotor of claim 1, wherein the first canceling resonator further includes a frequency adjuster configured to vary a volume of the body to vary a tuned frequency of the first canceling resonator.

8. The wave rotor of claim 7, wherein the tuned frequency is about equal to a frequency of the rotor passages passing the port aperture when the rotor drum is rotated.

9. The wave rotor of claim 1, wherein the first canceling resonator includes an orifice plate covering the mouth of the first canceling resonator and formed to include a plurality of orifices extending through the orifice plate.

10. The wave rotor of claim 1, wherein the body and the neck are formed such that the only entrance into the cavity is through the mouth.

11. A wave rotor comprising a rotor drum mounted for rotation about a central axis of the wave rotor, the rotor drum formed to include a plurality of combustion rotor passages that extend along the central axis, an outlet end plate aligned axially with the rotor drum and formed to include an outlet port aperture extending axially through the outlet end plate along an arc around the central axis and aligned radially with the combustion rotor passages, the outlet end plate includes a leading edge wall and a trailing edge wall spaced apart circumferentially from the leading edge wall to define a portion of the outlet port aperture, and the combustion rotor passages are configured to rotate in a direction from the leading edge wall to the trailing edge wall, and a first canceling resonator including a body and a neck that cooperate to define a cavity, wherein the neck is narrower than the body and is formed to include a mouth positioned adjacent to the leading edge wall, wherein the outlet end plate further includes a radial outer wall interconnecting the leading edge wall and the trailing edge wall and a radial inner wall radially spaced apart from the radial outer wall and interconnecting the leading edge wall and the trailing edge wall to form the port aperture, and the first canceling resonator extends radially away from the outlet port aperture, and wherein the body and the neck are formed such that the only entrance into the cavity is through the mouth; and wherein the first canceling resonator has a tuned frequency about equal to a frequency of the combustion rotor passages passing the port aperture when the rotor drum is rotated.

12. The wave rotor of claim 11, further including a second canceling resonator, a mouth of the second canceling resonator is positioned adjacent to the trailing edge wall, and the second canceling resonator extends circumferentially away from the outlet port aperture and the first canceling resonator.

13. The wave rotor of claim 11, wherein the mouth is positioned adjacent to one of the radial outer wall and the radial inner wall.

14. The wave rotor of claim 13, wherein the mouth is positioned directly adjacent to the radial outer wall.

15. The wave rotor of claim 11, further including a second canceling resonator and an inlet end plate axially spaced apart from the outlet end plate and a mouth of the second canceling resonator is positioned adjacent to an inlet port aperture formed in the inlet end plate.

16. The wave rotor of claim 11, wherein the first canceling resonator further includes a frequency adjuster configured to vary a volume of the body to vary the tuned frequency of the first canceling resonator.

17. The wave rotor of claim 11, wherein the first canceling resonator includes an orifice plate covering the mouth of the first canceling resonator and formed to include a plurality of orifices extending through the orifice plate.

* * * * *